US012637773B2

(12) United States Patent
Iwanaga et al.

(10) Patent No.: US 12,637,773 B2
(45) Date of Patent: May 26, 2026

(54) CHEMICAL TREATMENT LIQUID AND METHOD FOR CHEMICAL TREATMENT OF TARGET METAL MATERIAL

(71) Applicant: DIPSOL CHEMICALS CO., LTD., Tokyo (JP)

(72) Inventors: Ryoji Iwanaga, Nagareyama (JP); Manabu Inoue, Nagareyama (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 0 days.

(21) Appl. No.: 18/723,314

(22) PCT Filed: Oct. 20, 2022

(86) PCT No.: PCT/JP2022/039100
§ 371 (c)(1),
(2) Date: Jun. 21, 2024

(87) PCT Pub. No.: WO2023/119826
PCT Pub. Date: Jun. 29, 2023

(65) Prior Publication Data

US 2025/0066924 A1 Feb. 27, 2025

(30) Foreign Application Priority Data

Dec. 22, 2021 (JP) ..... 2021-208322

(51) Int. Cl.
*C23F 11/18* (2006.01)

(52) U.S. Cl.
CPC ..... *C23F 11/185* (2013.01)

(58) Field of Classification Search
CPC ..... C23F 11/185
See application file for complete search history.

(56) References Cited

U.S. PATENT DOCUMENTS

2005/0067057 A1 3/2005 Ishikura et al.

FOREIGN PATENT DOCUMENTS

| | | | | |
|---|---|---|---|---|
| JP | 2002-060699 | A | | 2/2002 |
| JP | 2003-213458 | A | | 7/2003 |
| JP | 2010-261058 | A | | 11/2010 |
| JP | 2012-012668 | A | | 1/2012 |
| WO | WO-03/074761 | A1 | | 9/2003 |
| WO | WO-2007/080849 | A1 | | 7/2007 |
| WO | WO2007080849 | | * | 7/2007 |

OTHER PUBLICATIONS

International Search Report and Written Opinion for PCT/JP2022/039100, dated Dec. 27, 2022, 8 pages. ISR only in English.

* cited by examiner

*Primary Examiner* — Nathan T Leong
(74) *Attorney, Agent, or Firm* — Foley & Lardner LLP

(57) ABSTRACT

The objective of the present invention is to provide a chemical treatment liquid capable of forming a coating having improved corrosion resistance. The present invention relates to a chemical treatment liquid containing a water-soluble titanium complex ion, a water-soluble vanadium-containing ion, and a fluorine ion, wherein the concentration of the fluorine ion is 1.2 g/L or more.

9 Claims, No Drawings

CHEMICAL TREATMENT LIQUID AND METHOD FOR CHEMICAL TREATMENT OF TARGET METAL MATERIAL

CROSS-REFERENCE TO RELATED APPLICATIONS

This application is the U.S. National Stage Application of International Application No. PCT/JP2022/039100, filed Oct. 20, 2022, which claims the benefit of and priority to Japanese Patent Application No. 2021-208322, filed Dec. 22, 2021, the entire contents of each of which is incorporated herein by reference in its entirety.

TECHNICAL FIELD

The present invention relates to a chemical treatment liquid and a method for chemical treatment of a target metal material and particularly to a chemical treatment liquid and a method for chemical treatment of a target metal material which do not require chromium.

BACKGROUND ART

In order to enhance corrosion resistance of a metal, chemical treatment is conducted. For this treatment, a chemical treatment liquid containing chromium and cobalt has conventionally been used; however, chromium and cobalt contained in the drainage water become sludge, which requires conducting an industrial waste treatment, making the cost of the drainage treatment very high. In addition, if a chromate treatment liquid is used, hexavalent chromium, which is toxic to the human bodies, can be eluted. For this reason, in order to avoid environmental pollutions or adverse effects on human bodies, a chromium-free chemical treatment liquid has been demanded.

Patent Literatures 1 to 4 describe chromium-free chemical treatment liquids containing a titanium complex fluoride ion and a vanadium compound ion containing pentavalent vanadium, and state that these chromium-free chemical treatment liquids are used for aluminum or an aluminum alloy. However, Patent Literatures 1 to 4 fail to describe a chromium-free chemical treatment liquid containing a fluorine ion at a specific concentration or more.

CITATION LIST

Patent Literatures

Patent Literature 1: Japanese Patent Application Publication No. 2010-261058

Patent Literature 2: Japanese Patent Application Publication No. 2003-213458

Patent Literature 3: Japanese Patent Application Publication No. 2002-60699

Patent Literature 4: International Publication No. 2003/074761

SUMMARY OF INVENTION

Problems to be Solved by the Invention

The corrosion resistances of coatings formed in accordance with the conventional chromium-free chemical treatment liquids are not sufficient, and a chromium-free chemical treatment liquid capable of forming a coating with further improved corrosion resistance has been demanded.

In view of this, an object of the present invention is to provide a chemical treatment liquid capable of forming a coating having improved corrosion resistance.

Means for Solution of the Problems

As a result of conducting earnest studies in order to solve the above-described problem, the present inventors found that a coating having a favorable corrosion resistance was able to be formed without using chromium by blending a high-concentration fluorine ion in a chemical treatment liquid containing a water-soluble titanium complex ion and a water-soluble vanadium-containing ion, and completed the present invention. Specifically, the present invention provides a chemical treatment liquid and a method for chemical treatment of a target metal material described below.

[1] A chemical treatment liquid comprising a water-soluble titanium complex ion, a water-soluble vanadium-containing ion, and a fluorine ion, wherein a concentration of the fluorine ion is 1.2 g/L or more.

[2] The chemical treatment liquid according to the above [1], wherein the water-soluble titanium complex ion is a titanium complex fluoride ion.

[3] The chemical treatment liquid according to the above [1] or [2], wherein a concentration of the water-soluble titanium complex ion in terms of titanium is 0.15 to 10 g/L.

[4] The chemical treatment liquid according to any one of the above [1] to [3], wherein the water-soluble vanadium-containing ion is a vanadium compound ion containing pentavalent vanadium.

[5] The chemical treatment liquid according to any one of the above [1] to [4], wherein a concentration of the water-soluble vanadium-containing ion in terms of vanadium is 0.4 to 15 g/L.

[6] The chemical treatment liquid according to any one of the above [1] to [5], further comprising at least one additional water-soluble metallic salt containing Zn, Co, W, Zr, Mn, Mo, Ta, Ce, Sr, or Fe.

[7] The chemical treatment liquid according to any one of the above [1] to [6], that does not contain a hexavalent chromium ion and/or a trivalent chromium ion.

[8] The chemical treatment liquid according to any one of the above [1] to [7] for use on an aluminum-containing metal material.

[9] A method for chemical treatment of a target metal material, comprising a step of immersing the target metal material into the chemical treatment liquid according to any one of the above [1] to [8] or a step of spraying the chemical treatment liquid according to any one of the above [1] to [8] onto the target metal material.

[10] The method according to the above [9], wherein the target metal material is an aluminum-containing metal material.

Advantageous Effects of Invention

According to the present invention, it is possible to form a coating having a favorable corrosion resistance on a surface of a target metal material by blending a high-concentration fluorine ion in a chemical treatment liquid containing a water-soluble titanium complex ion and a water-soluble vanadium-containing ion. In this case, since it is unnecessary to blend chromium in the chemical treatment liquid, it becomes possible to provide an environmentally friendly chemical treatment liquid.

DESCRIPTION OF EMBODIMENTS

Hereinafter, the present invention will be described in further detail.

The present invention relates to a chemical treatment liquid comprising a water-soluble titanium complex ion, a water-soluble vanadium-containing ion, and a fluorine ion. As the above water-soluble titanium complex ion, a water-soluble titanium complex ion which is normally used in the art can be employed without particular limitation, but for example, the above water-soluble titanium complex ion may be a titanium complex fluoride ion. More specifically, the above water-soluble titanium complex ion may be one derived from at least one titanium compound selected from the group consisting of hexafluorotitanic acid, sodium hexafluorotitanate, potassium hexafluorotitanate, and ammonium hexafluorotitanate, or the like. The concentration of the above water-soluble titanium complex ion is not particularly limited as long as chemical treatment can be conducted, but may be, for example, about 0.15 to about 10 g/L, and is preferably about 0.3 to about 2 g/L, at concentration in terms of titanium. Note that since a fluorine ion is difficult to release from a fluoro complex such as the above titanium complex fluoride ion, it is necessary to additionally mix a compound which easily brings in a fluorine ion as described later with a chemical treatment liquid in order to achieve a high-concentration fluorine ion which is necessary for the chemical treatment liquid of the present invention.

As the above water-soluble vanadium-containing ion, a water-soluble vanadium-containing ion which is normally used in the art can be employed without particular limitation, but for example, the above water-soluble vanadium-containing ion may be a vanadium compound ion containing pentavalent vanadium. More specifically, the above water-soluble vanadium-containing ion may be one derived from at least one vanadium compound selected from the group consisting of sodium vanadate, potassium vanadate, ammonium vanadate, sodium metavanadate, potassium metavanadate, ammonium metavanadate, and vanadium oxytrichloride, or the like. The concentration of the above water-soluble vanadium-containing ion is not persulphuric particularly limited as long as chemical treatment can be conducted, but may be, for example, about 0.4 to about 15 g/L, and is preferably about 0.5 to about 1.2 g/L, at concentration in terms of vanadium.

The chemical treatment liquid of the present invention contains the above fluorine ion at a high concentration, and specifically contains the above fluorine ion at a concentration of about 1.2 g/L or more, and preferably about 1.4 g/L or more. The upper limit value of the concentration of the above fluorine ion is not particularly limited, but may be, for example, about 2 g/L or less. The above fluorine ion is a free fluorine ion and can be clearly distinguished from a fluorine atom which has formed a complex ion with a metal. As the compound which brings in the above fluorine ion, a compound which is normally used in the art can be employed without particular limitation, but for example, the above fluorine ion may be one derived from at least one compound selected from the group consisting of sodium fluoride, sodium hydrogen fluoride, potassium fluoride, potassium hydrogen fluoride, ammonium fluoride, ammonium hydrogen fluoride, and hydrofluoric acid, or the like.

The chemical treatment liquid of the present invention can form a coating having improved corrosion resistance due to the presence of the high-concentration fluorine ion, and thus does not require chromium. That is, in a certain aspect, the above chemical treatment liquid does not contain a hexavalent chromium ion and/or a trivalent chromium ion.

The chemical treatment liquid of the present invention can be used to conduct chemical treatment of various target metal materials. The above target metal material is not particularly limited, but for example, the above target metal material may be a material formed from aluminum, zinc, iron, nickel, copper, or an alloy of these, or a material plated with these metals, and is preferably an aluminum-containing metal material (including an aluminum-plated product and an aluminum alloy-plated product).

In a certain aspect, the chemical treatment liquid of the present invention further contains at least one additional water-soluble metallic salt containing Zn, Co, W, Zr, Mn, Mo, Ta, Ce, Sr, or Fe (for example, a nitrate salt, a chloride salt, a sulfate salt, or the like). Preferably, the above water-soluble metallic salt contains Zn, and a zinc ion is brought in the above chemical treatment liquid. When such a water-soluble metallic salt is contained, the corrosion resistance of the coating to be formed can be further improved. The concentration of the water-soluble metallic in salt is not particularly limited as long as chemical treatment can be conducted, but may be, for example, about 0.4 to about 30.0 g/L, and is preferably about 0.8 to about 3.0 g/L.

In a certain aspect, the chemical treatment liquid of the present invention may further contain an oxidizing agent. As the above oxidizing agent, an oxidizing agent which is normally used in the art can be employed without particular limitation, but for example, the above oxidizing agent may contain at least one selected from the group consisting of nitric acid, nitrous acid, sulfuric acid, sulfurous acid, persulfuric acid, phosphoric acid, hydrochloric acid, bromic acid, chloric acid, hypochlorous acid, hydrogen peroxide, permanganic acid, metavanadic acid, tungstic acid, molybdic acid, salts of these, and the like, and preferably contains a nitrate salt which releases nitric acid and/or a nitrate ion. The above nitrate salt is not particularly limited, but is preferably water-soluble, and specifically may contain ammonium nitrate, sodium nitrate, potassium nitrate, lithium nitrate, chromium nitrate, aluminum nitrate, zirconyl nitrate, cobalt nitrate, or the like. The concentration of the above oxidizing agent is not particularly limited as long as chemical treatment can be conducted, but may be, for example, about 0.5 to about 30 g/L, and is preferably about 1.0 to about 10 g/L, in total. In addition, in the case where the above oxidizing agent contains the above nitric acid and/or the above nitrate salt, the concentration of the above nitric acid and the above nitrate salt in total may be, for example, about 1.5 to about 18 g/L, and is preferably about 2.5 to about 8.0 g/L, as a nitrate ion. By causing the above oxidizing agent to be contained in the chemical treatment liquid, the formation of a chemical coating can be promoted on a specific metal material, and more excellent appearance and corrosion resistance can be achieved. For example, when the chemical treatment liquid of the present invention contains a nitrate salt which releases the above nitric acid and/or the above nitrate ion, a chemical treatment liquid which can be suitable for both an aluminum-containing metal material and a zinc-containing metal material can be obtained.

The pH of the chemical treatment liquid of the present invention is not particularly limited, but may be, for example, about 3.2 to about 5.3, and preferably about 3.4 to about 4.7. In addition, the chemical treatment liquid of the present invention may further contain any additive which is normally used in the art as long as the object of the present invention is not impaired.

In another aspect, the present invention relates also to a method for chemical treatment of a target metal material and comprises a step of immersing the above target metal material into the chemical treatment liquid of the present invention or a step of spraying the chemical treatment liquid of the present invention onto the above target metal material. The type of the target metal material to which the method of the present invention is applied is not particularly limited, but for example, the above target metal material may be a material formed from aluminum, zinc, iron, nickel, copper or an alloy of these, or a material plated with these metals, and is preferably an aluminum-containing metal material (including an aluminum-plated product and an aluminum alloy-plated product).

In the method of the present invention, the treatment temperature and the treatment time when the above target metal is brought into contact with the above chemical treatment liquid are not particularly limited, but for example, the treatment temperature may be about 15 to about 55° C., and preferably about 25 to about 45° C., and the treatment time may be about 20 to about 400 seconds, and preferably about 30 to about 200 seconds. In addition, the method of the present invention may further include any step which is normally used in the art as long as the object of the present invention is not impaired.

Hereinafter, the present invention will be described in detail by using Examples, but the scope of the present invention is not limited to these Examples.

EXAMPLES

Test Example 1

Ammonium hexafluorotitanate, sodium metavanadate, potassium fluoride, and zinc sulfate were mixed, and the pH was adjusted to 4.00 by using caustic soda or sulfuric acid to prepare chemical treatment liquids 1 to 6 having compositions shown in Table 1 (the concentrations of $F^-$, $TiF_6^{2-}$, $VO_3^-$, and $Zn^{2+}$ were based respectively on the amounts of potassium fluoride, ammonium hexafluorotitanate, sodium metavanadate, and zinc sulfate blended, and although these compounds are all ionized, it was assumed that $F^-$ was not generated from $TiF_6^{2-}$), which will be described later, in accordance with a conventional method. Chemical treatment was performed on ADC12 (manufactured by Nippon Testpanel Co., Ltd.), which is an Al—Si—Cu alloy of a cast material, by using each chemical treatment liquid. Specifically, the ADC12 was degreased and washed, and sufficiently rinsed with running water of a tap water to clean up the surface of the ADC12. Thereafter, chemical treatment was performed on the ADC12 under conditions of 40° C. and 60 seconds. The ADC12 on which the chemical treatment had been performed was sufficiently washed with tap water and ion-exchange water, and then left to stand in an electric drying furnace maintained at 60° C. for 10 minutes to be dried. Then, the neutral salt spray test (NSS) of methods of salt spray testing (JIS Z 2371) was conducted, and the corrosion resistance of the coating formed (a ratio of the area in which a white product was attached to the surface area of the target metal material) was evaluated in accordance with the following criteria after a specific period of time elapsed from loading into a salt spray testing machine. Results are shown in Table 1.

(Corrosion Resistance of Coating)

○: No white product

Δ: White product of less than 5% x: White product of 5% or more

TABLE 1

Compositions and Test Results of Chemical Treatment Liquids

| | Chemical Treatment Liquid | | | | | |
|---|---|---|---|---|---|---|
| | 1 | 2 | 3 | 4 | 5 | 6 |
| Composition (g/L) | | | | | | |
| $F^-$ | 0.33 | 0.65 | 1.30 | 1.63 | 1.96 | 2.28 |
| $TiF_6^{2-}$ (*1) | 0.40 | 0.40 | 0.40 | 0.40 | 0.40 | 0.40 |
| $VO_3^-$ (*2) | 0.84 | 0.84 | 0.84 | 0.84 | 0.84 | 0.84 |
| $Zn^{2+}$ | 1.13 | 1.13 | 1.13 | 1.13 | 1.13 | 1.13 |
| Corrosion resistance | | | | | | |
| 24 hours | Δ | ○ | ○ | ○ | ○ | ○ |
| 48 hours | x | Δ | ○ | ○ | ○ | ○ |
| 72 hours | x | x | Δ | ○ | ○ | Δ |

*1 In terms of Ti

*2 In terms of V

In the chemical treatment liquids containing a water-soluble titanium complex ion ($TiF_6^{2-}$) and a water-soluble vanadium-containing ion ($VO_3^-$), a coating having a high corrosion resistance was able to be formed on the surface of the above alloy by making the concentration of the fluorine ion (F.) higher than the conventional technique (see particularly the chemical treatment liquids 3 to 6). Note that in the present test, the appearance of the target metal material was not impaired by an etching action even though the fluorine ion was contained at high concentrations in the chemical treatment liquids.

Test Example 2

Chemical treatment was conducted in the same manner as in Test Example 1 except that A2017 (manufactured by Nippon Testpanel Co., Ltd.), which is an Al—Cu alloy of an expanded material, was employed instead of the ADC12 of a cast material, and the corrosion resistance of the coating formed was evaluated. Results are shown in Table 2.

TABLE 2

Test results

| | Chemical Treatment Liquid | | | | | |
|---|---|---|---|---|---|---|
| | 1 | 2 | 3 | 4 | 5 | 6 |
| Corrosion resistance | | | | | | |
| 48 hours | ○ | ○ | ○ | ○ | ○ | ○ |
| 72 hours | Δ | Δ | ○ | ○ | ○ | ○ |
| 96 hours | x | x | ○ | ○ | ○ | ○ |

Even when the type of the alloy material was changed, a coating having a high corrosion resistance was able to be formed on the surface of the above alloy by making the concentration of the fluorine ion ($F^-$) higher than the conventional technique (see particular the chemical treatment liquids 3 to 6).

Test Example 3

Chemical treatment was conducted in the same manner as in Test Example 1 or Test Example 2 except that chemical treatment liquids shown in Table 3 or Table 4 were used, and the corrosion resistance of the coating formed on the surface of the ADC12 or A2017 was evaluated. Results are shown in Table 3 and Table 4.

TABLE 3

Compositions and Test Results of Chemical Treatment Liquids

| | Chemical Treatment Liquid | | | | | | |
|---|---|---|---|---|---|---|---|
| | 7 | 8 | 9 | 10 | 11 | 12 | 13 |
| Composition (g/L) | | | | | | | |
| $F^-$ | 1.63 | 1.63 | 1.63 | 1.63 | 1.63 | 1.63 | 1.63 |
| $TiF_6^{2-}$ (*1) | 0.16 | 0.24 | 0.32 | 0.40 | 0.47 | 0.55 | 0.63 |
| $VO_3^-$ (*2) | 0.84 | 0.84 | 0.84 | 0.84 | 0.84 | 0.84 | 0.84 |
| $Zn^{2+}$ | 0.45 | 0.68 | 0.90 | 1.13 | 1.35 | 1.58 | 1.80 |
| Corrosion resistance (ADC12) | | | | | | | |
| 24 hours | ○ | ○ | ○ | ○ | ○ | ○ | ○ |
| 48 hours | ○ | ○ | ○ | ○ | ○ | ○ | ○ |
| 72 hours | Δ | Δ | ○ | ○ | ○ | ○ | ○ |
| Corrosion resistance (A2017) | | | | | | | |
| 48 hours | ○ | ○ | ○ | ○ | ○ | ○ | ○ |
| 72 hours | ○ | ○ | ○ | ○ | ○ | ○ | ○ |
| 96 hours | Δ | ○ | ○ | ○ | ○ | ○ | ○ |

*1 In terms of Ti

*2 In terms of V

TABLE 4

Compositions and Test Results of Chemical Treatment Liquids

| | Chemical Treatment Liquid | | | | | | |
|---|---|---|---|---|---|---|---|
| | 14 | 15 | 16 | 17 | 18 | 19 | 20 |
| Composition (g/L) | | | | | | | |
| $F^-$ | 1.63 | 1.63 | 1.63 | 1.63 | 1.63 | 1.63 | 1.63 |
| $TiF_6^{2-}$ (*1) | 0.40 | 0.40 | 0.40 | 0.40 | 0.40 | 0.40 | 0.40 |
| $VO_3^-$ (*2) | 0.42 | 0.63 | 0.84 | 1.05 | 1.26 | 1.47 | 1.68 |
| $Zn^{2+}$ | 1.13 | 1.13 | 1.13 | 1.13 | 1.13 | 1.13 | 1.13 |
| Corrosion resistance (ADC12) | | | | | | | |
| 24 hours | ○ | ○ | ○ | ○ | ○ | ○ | ○ |
| 48 hours | ○ | ○ | ○ | ○ | ○ | ○ | ○ |
| 72 hours | ○ | ○ | ○ | ○ | ○ | ○ | ○ |
| Corrosion resistance (A2017) | | | | | | | |
| 48 hours | ○ | ○ | ○ | ○ | ○ | ○ | ○ |
| 72 hours | ○ | ○ | ○ | ○ | ○ | ○ | ○ |
| 96 hours | ○ | ○ | ○ | ○ | ○ | ○ | ○ |

*1 In terms of Ti

*2 In terms of V

In all of the conditions shown in Table 3 and Table 4, a coating having a favorable corrosion resistance was formed. It was found that as long as the fluorine ion was sufficiently contained, a coating having a favorable corrosion resistance was formed even when the concentrations of a water-soluble titanium complex ion ($TiF_6^{2-}$), a water-soluble vanadium-containing ion ($VO_3^-$), and a zinc ion in the chemical treatment liquid were changed within the ranges of Table 3 and Table 4.

Test Example 4

Chemical treatment was conducted in the same manner as in Test Example 1 or Test Example 2 except that the pH of the chemical treatment liquid 4 was changed as shown in Table 5, and the corrosion resistance of the coating formed on the surface of the ADC12 or A2017 was evaluated. Results are shown in Table 5.

TABLE 5 pH and Test Results of Chemical Treatment Liquids

| | Chemical Treatment Liquid | | | |
|---|---|---|---|---|
| | 21 | 22 | 23 | 24 |
| pH | 3.5 | 3.75 | 4.0 | 4.5 |
| Corrosion resistance (ADC12) | | | | |
| 24 hours | ○ | ○ | ○ | ○ |
| 48 hours | ○ | ○ | ○ | ○ |
| 72 hours | ○ | ○ | ○ | ○ |
| Corrosion resistance (A2017) | | | | |
| 48 hours | ○ | ○ | ○ | ○ |
| 72 hours | ○ | ○ | ○ | ○ |
| 96 hours | ○ | ○ | ○ | ○ |

In all of the conditions shown in Table 5, a coating having a favorable corrosion resistance was formed. It was found that as long as the fluorine ion was sufficiently contained, a coating having a favorable corrosion resistance was formed even when the pH of the chemical treatment liquid was changed within the range of Table 5.

Test Example 5

Chemical treatment was conducted in the same manner as in Test Example 1 or Test Example 2 except that the chemical treatment was conducted with temperatures and times shown in Table 6 by using the chemical treatment liquid 4, and the corrosion resistance of the coating formed on the surface of the ADC12 or A2017 was evaluated. Results are shown in Table 6.

TABLE 6

Conditions and Test Results of Chemical Treatment Liquids

| | Chemical treatment conditions | | | | |
|---|---|---|---|---|---|
| | a | b | c | d | e |
| Treatment conditions | | | | | |
| Tmperature (° C.) | 40 | 30 | 40 | 40 | 40 |
| Time(sec) | 60 | 60 | 30 | 120 | 180 |
| Corrosion resistance (ADC12) | | | | | |
| 24 hours | ○ | ○ | ○ | ○ | ○ |
| 48 hours | ○ | ○ | ○ | ○ | ○ |
| 72 hours | ○ | Δ | ○ | ○ | ○ |
| Corrosion resistance (A2017) | | | | | |
| 48 hours | ○ | ○ | ○ | ○ | ○ |
| 72 hours | ○ | ○ | ○ | ○ | ○ |
| 96 hours | ○ | ○ | ○ | ○ | ○ |

In all of the conditions shown in Table 6, a coating having a favorable corrosion resistance was formed. It was found that as long as the fluorine ion was sufficiently contained, a coating having a favorable corrosion resistance was formed even when the temperature and time of the chemical treatment were changed within the ranges of Table 6.

From the above, it was found that by blending a high-concentration fluorine ion in a chemical treatment liquid containing a water-soluble titanium complex ion and a water-soluble vanadium-containing ion, a coating having a favorable corrosion resistance was able to be formed on the surface of a target metal. In this case, since it is unnecessary to blend chromium in the chemical treatment liquid, it becomes 10 possible to provide an environmentally friendly chemical treatment liquid.

The invention claimed is:

1. A chemical treatment liquid comprising a water-soluble titanium complex ion, a water-soluble vanadium-containing ion, and a fluorine ion, wherein a concentration of the fluorine ion is 1.2 g/L or more; and wherein the chemical treatment liquid is free of hexavalent chromium ions and trivalent chromium ions.

2. The chemical treatment liquid according to claim 1, wherein the water-soluble titanium complex ion is a titanium complex fluoride ion.

3. The chemical treatment liquid according to claim 1, wherein a concentration of the water-soluble titanium complex ion in terms of titanium is 0.15 to 10 g/L.

4. The chemical treatment liquid according to claim 1, wherein the water-soluble vanadium-containing ion is a vanadium compound ion containing pentavalent vanadium.

5. The chemical treatment liquid according to claim 1, wherein a concentration of the water-soluble vanadium-containing ion in terms of vanadium is 0.4 to 15 g/L.

6. The chemical treatment liquid according to claim 1, further comprising at least one additional water-soluble metallic salt containing Zn, Co, W, Zr, Mn, Mo, Ta, Ce, Sr, or Fe.

7. The chemical treatment liquid according to claim 1 for use on an aluminum-containing metal material.

8. A method for chemical treatment of a target metal material, comprising a step of immersing the target metal material into the chemical treatment liquid according to claim 1 or a step of spraying the chemical treatment liquid according to claim 1 onto the target metal material.

9. The method according to claim 8, wherein the target metal material is an aluminum-containing metal material.

* * * * *